US005176856A

United States Patent [19]

Takahashi et al.

[11] Patent Number: 5,176,856

[45] Date of Patent: Jan. 5, 1993

[54] ULTRASONIC WAVE NEBULIZER

[75] Inventors: Minoru Takahashi; Makoto Ono, both of Chiba, Japan

[73] Assignee: TDK Corporation, Tokyo, Japan

[21] Appl. No.: 819,278

[22] Filed: Jan. 13, 1992

[30] Foreign Application Priority Data

Jan. 14, 1991 [JP] Japan ..... 3-004064[U]

[51] Int. Cl.[5] ..... B01F 3/04

[52] U.S. Cl. ..... 261/142; 261/81; 261/DIG. 48; 392/441; 219/505

[58] Field of Search ..... 261/142, 81, DIG. 48; 392/441, 458; 219/505

[56] References Cited

U.S. PATENT DOCUMENTS

| | | | |
|---|---|---|---|
| 3,146,950 | 9/1964 | Lancaster | 392/441 |
| 4,203,027 | 5/1980 | O'Hare et al. | 261/142 |
| 4,395,623 | 7/1983 | Shimada et al. | 392/458 |
| 4,640,804 | 2/1987 | Mizoguchi | 261/DIG. 48 |
| 4,721,846 | 1/1988 | Lupoli et al. | 219/505 |
| 4,776,990 | 10/1988 | Verity | 261/142 |
| 4,869,853 | 9/1989 | Chon | 261/142 |
| 4,961,885 | 10/1990 | Avrahami et al. | 261/142 |

FOREIGN PATENT DOCUMENTS 238237 9/1990 Japan .

*Primary Examiner*—Tim Miles

*Attorney, Agent, or Firm*—Martin Novack

[57] ABSTRACT

An ultrasonic wave nebulizer has a vibrator-heater assembly unit (4) mounted at bottom of a water container (1) for converting water to mist, and heating water to provide warm mist. The assembly unit (4) has a circular piezoelectric vibrator element (9), and a ring-shaped conductive plate (7) surrounding said vibrator element (9). A heater (11) is attached on the rear surface of the conductive plate (7) so that the heater (11) is out of water. The assembly unit (4) has also a circuit element (13) for energizing the vibrator element (9). Water is heated, preferably, at less than 70° C.

8 Claims, 4 Drawing Sheets

ULTRASONIC WAVE NEBULIZER

BACKGROUND OF THE INVENTION

The present invention relates to an ultrasonic wave nebulizer for converting water or solution which includes a chemical substance to mist by applying ultrasonic wave vibration to water or said solution.

Conventionally, some systems for converting water to mist have been known. Some of them are (a) an electrode type system which has a pair of electrodes in water which is subject to atomization to generate joule heat by flowing current between electrodes and evaporating water, (b) a pan system which heats water in a pan, (c) a warm air-flow system which evaporates water which is included in porous material by applying warm air-flow to water, and (d) an ultrasonic wave vibrator type which excites water with ultrasonic wave energy. Among them, an atomizer or a nebulizer except an ultrasonic wave vibrator type has the disadvantage that the atomization efficiency which is defined as the ratio of the generated mist to input power is poor, since 539 cal of vaporation heat is necessary for atomizing 1 cc of water. The ultrasonic wave vibration type has 20 times as high efficiency as that of other types of nebulizers in atomizing efficiency, but has the disadvantage that generated mist is cool, and the operation of the nebulizer decreases the room temperature. This is uncomfortable to a human body in winter. Further, a higher atomizing efficiency for an ultrasonic wave vibration type is desirable.

One disadvantage of a prior ultrasonic wave vibration type nebulizer is that bacteria and/or fungus included in water is dispersed into air. Japanese patent laid open publication 238237/1990 proposed a solution to that disadvantage, by heating water by using a heater installed in a water container.

However, that publication has the disadvantages that the structure of the apparatus is complicated since a vibrator and a heater are mounted separately, and further, a heater is installed in water, and control of a heater is complicated so that a heater operates after water is heated sufficiently for killing bacteria and/or fungus. Thus, a timer circuit or a thermostat circuit must be coupled with a heater. Further, a heater installed in water raises a problem of electrical insulation.

SUMMARY OF THE INVENTION

It is an object, therefore, of the present invention to provide a new and improved nebulizer by overcoming the disadvantages and limitations of a prior nebulizer.

It is also an object of the present invention to provide a nebulizer which has higher efficiency to convert water to mist for unit power supply.

It is also an object of the present invention to provide a nebulizer which generates warm mist, which is more comfortable to a human body.

It is also an object of the present invention to provide a nebulizer in which the manufacturing steps of the nebulizer are simple.

It is also an object of the present invention to provide a nebulizer in which it is small in size, and safe in operation.

The above and other objects are attained by an ultrasonic wave nebulizer comprising a water container (1), and a piezoelectric vibrator element (9) mounted at bottom of said water container (1) so that said vibrator element (9) contacts with water, and ultrasonic energy generated by said vibrator element (9) converts water to mist; said nebulizer comprising said water container (1) having a bottom opening (3) which is closed by a vibrator/heater assembly unit (4) with water tight; said vibrator/heater assembly unit (4) having a non-conductive frame (6) which has a center hole (**6*a*); a ring-shaped conductive plate (7) fixed to said frame (6) so that an outer periphery of the plate (7) engages with an inner periphery of said central hole (6*a*); a resilient cylindrical vibrator holder (8) coupled with an inner periphery of said plate (7); a vibrator element (9) fixed in said vibrator holder (8) so that one surface of the vibrator element (9) contacts with water in said water container (1); at least one flat heater (11) attached at the bottom surface of said conductive plate (7); a substrate (12) fixed to said frame (6) so that a spacing is provided between the substrate (12) and the frame (6); a circuit element (13) for energizing said vibrator element (9), mounted on said substrate (12); and means (5) for fixing said unit (4) to said water container (1**).

BRIEF DESCRIPTION OF THE DRAWINGS

The foregoing and other objects, features, and attendant advantages will be appreciated as the same becomes better understood by means of the following description and accompanying drawings wherein.

DESCRIPTION OF THE PREFERRED EMBODIMENTS

Figure 1A:
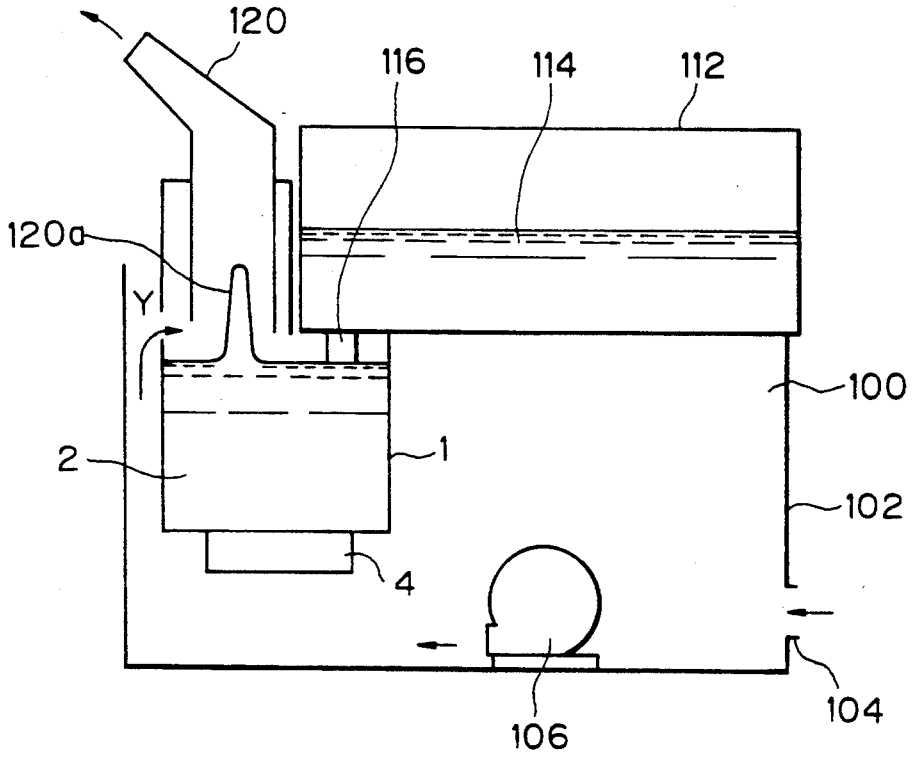
FIG. 1A shows a cross section of a general view of an ultrasonic wave type nebulizer according to the present invention.

FIG. 1A shows the structure of the ultrasonic wave nebulizer which the present invention is applied. In the figure, the ultrasonic wave type nebulizer 100 for converting water to mist has a housing 102, on which a water tank 112 is mounted. The water tank 112 which includes water 114 has a bottom tap 116, which is closed when the water tank is removed, and is open when the water tank is placed on the housing 102 which has a projection (not shown) through the tap 116. The water container 1 which includes water 2 is fixed to the housing 102, and is supplied water from the water tank 112 through the tap 116 so that the water level in the container 1 is almost constant.

A vibrator/heater assembly unit 4 for vibrating water and warming water is fixed at the bottom of the water container 1. When the assembly unit 4 vibrates water, water column **120*a* is generated on the surface of water 2, and the water in the column 120*a* is converted to fine mist, which is output through a hollow cylindrical member 120** into an air.

A fan 106 is provided in the housing 102 so that an air circulation from an air inlet 104, through the assembly unit 4, and the arrow Y, to the cylindrical member 120. That air circulation functions to output the generated mist into a room, and to cool the vibration element.

Figure 1B:
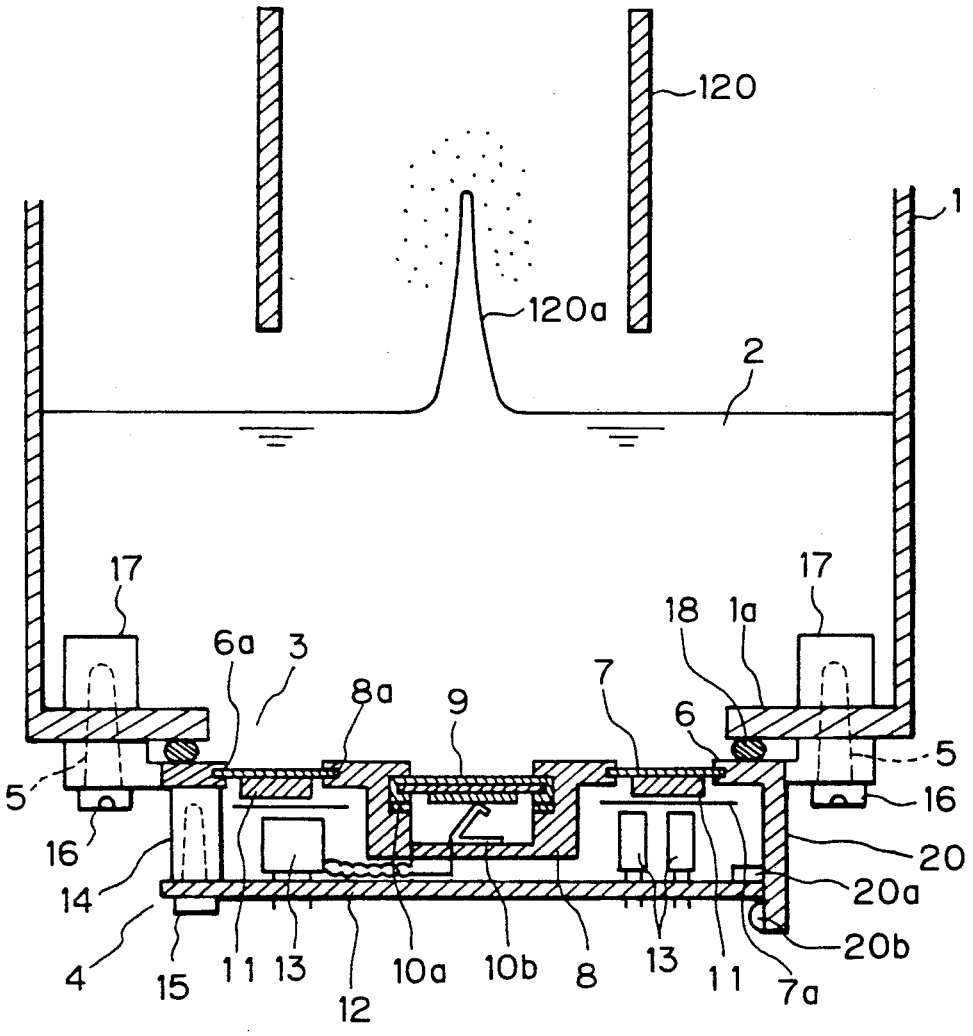
FIG. 1B is a vertical cross sectional view of a nebulizer according to the present invention.
Figure 2:
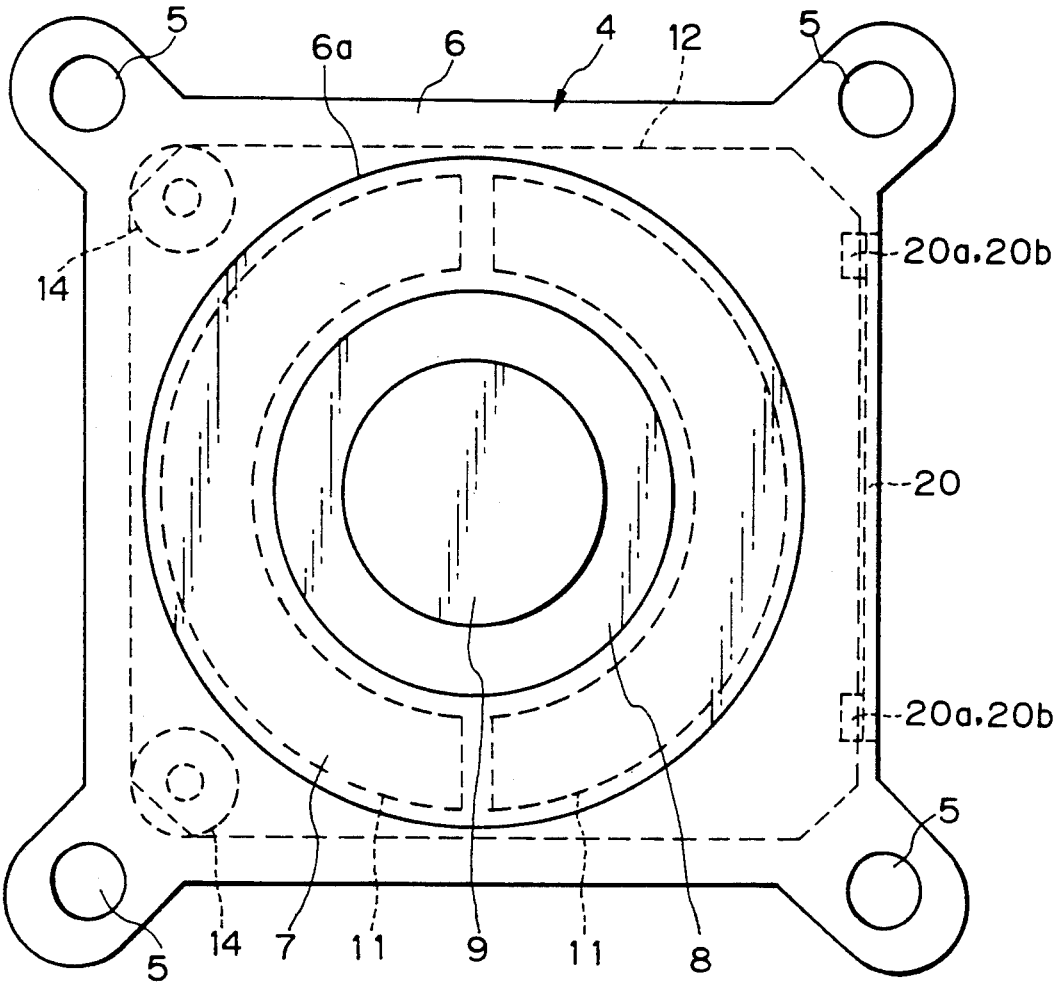
FIG. 2 is a plane view of a vibrator/heater assembly unit according to the present invention.

FIG. 1B shows a cross sectional view of an ultrasonic wave nebulizer according to the present invention, and FIG. 2 shows a plane view of a vibrator/heater assembly unit. In the figures, the numeral 1 is a water container for containing water or liquid 2. The container 1 has an opening 3 at the bottom of the container 1, and the vibrator/heater unit 4 is fixed to the bottom of the container 1 so that said unit 4 encloses the opening 3.

The unit 4 has, as shown in FIG. 2, an essentially rectangular frame 6 which has a hole 5 at each corner for fixing the frame 6 to the container 1. The frame 6 is made of plastics.

The frame 6 has a circular center opening 6*a* with a circular slit inside of said opening 6*a*. A ring shaped conductive plate 7 is engaged with said slit with water tight condition. The conductive plate 7 occupies the outer area of said opening 6*a*. A cylindrical vibrator holder 8 is fixed to the inside of said ring shaped conductive plate 7. The conductive plate 7 is made of metal, like aluminum, copper or stainless steel. The holder 8 is made of resilient material, like gum, which has a circular slit 8*a* along the outer periphery of the same so that said slit engages with the conductive plate 7.

A piezoelectric vibrator 9 which is in circular disc shape is engaged with the inner surface of the holder 8 with water tight condition. The vibrator 9 is provided with an upper electrode which contacts with water and is offset a little to the bottom surface of the vibrator disc 9, and a bottom electrode which is smaller in diameter than that of the vibrator 9. The numerals 10*a* and 10*b* are electrodes for power supply to the vibrator 9 through the offset portion of said upper electrode and said bottom electrode attached on the vibrator 9.

The conductive plate 7 is provided with a pair of flat fan-shaped heaters 11 at the rear surface of the conductive plate 7 so that heater 11 does not contact with water. Heater 11 is preferably made of ceramics, in which a nichrome line is sandwiched by a pair of ceramics plates, and still preferably made of a PTC element (positive temperature coefficient ceramics heater) which has the nature that the electric resistance increases with the temperature rise so that the power consumption in the heater decreases when the temperature is high. The use of a PTC element is preferable in that the temperature is automatically controlled with no external temperature control circuit.

Heater 11 has a pair of electrodes (not shown) for power supply to the heater.

Preferably, a heat-shield 7*a* is provided under heater 11 with some spacing between heater and the shield for preventing heat propagation to an electronic circuit 13.

The numeral 12 is a substrate for supporting the circuit 13 which energizes the vibrator 9. The substrate 12 is rectangular, and is fixed to said frame having a vertical wall 20 which is integral with said frame 6. The vertical wall 20 has a pair of projections 20*a* and 20*b* so that a slit is provided between said projections, and the substrate 12 is engaged with said slit. The substrate 12 has a column 14, through which the substrate 12 is fixed to the frame 6 by using a pair of screws 15.

The water container 1 has a horizontal chip 1*a* which defines an opening 6*a*. The chip 1*a* is provided at the bottom of the container 1.

The unit 4 is removably fixed at the bottom of the container 1 by using four screws 16, which engage with the column 17 provided to the chip 1*a* of the container 1, through the hole 5 on the frame 6. The numeral 18 is a water seal member made of gum provided between the unit 4 and the container 1.

In operation, the heater 11 is electrically heated, and the water 2 in the container 1 is heated by said heater 11 through the conductive plate 7. When the water is warm, the atomization efficiency by the vibrator 9 is extremely high as compared with that when the water is cool. And, further, the atomized mist is warm, and is comfortable to a human body.

Figure 3:
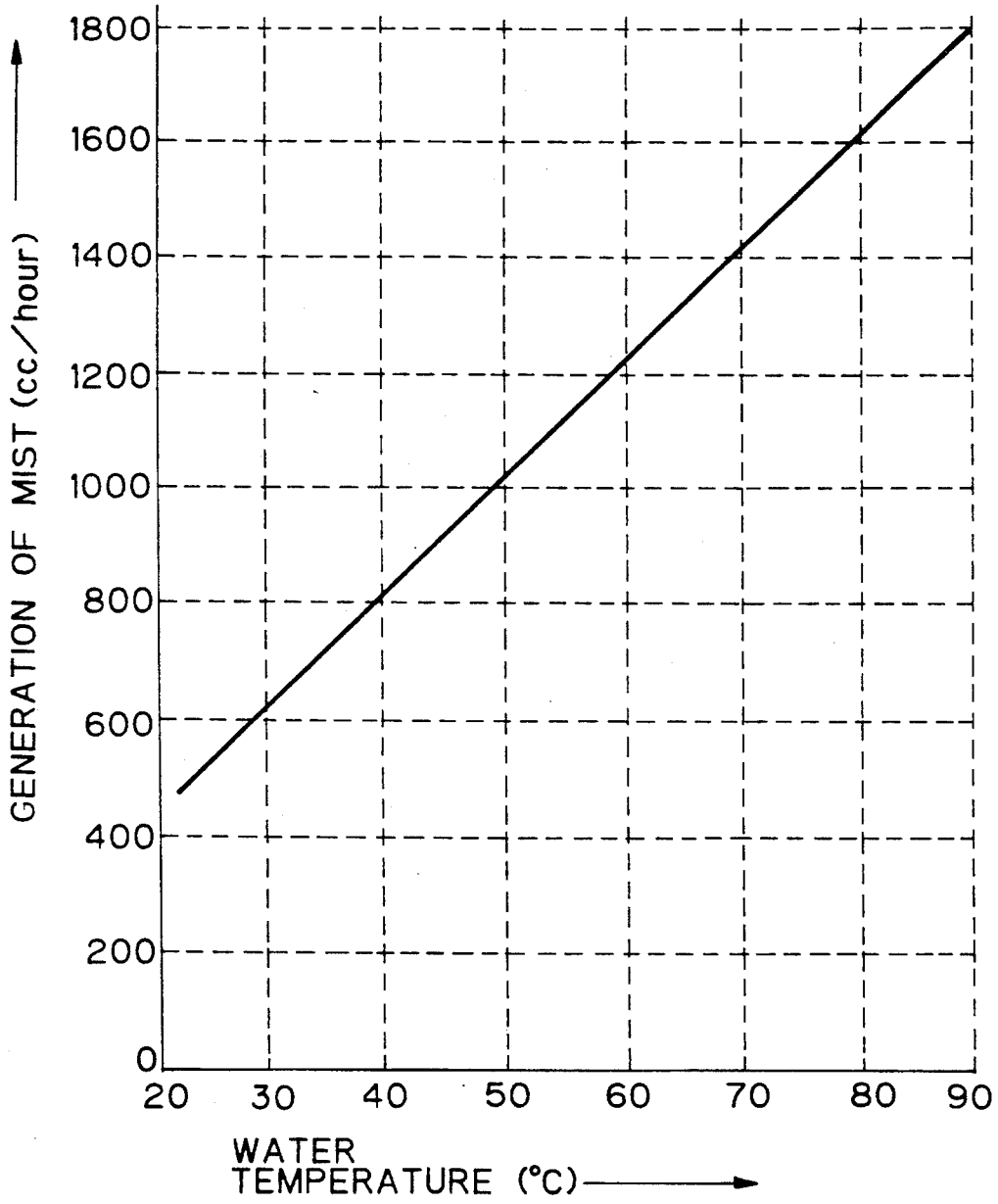
FIG. 3 is a curve showing the relationship between water temperature and generation of mist.

FIG. 3 shows the relations between the water temperature (horizontal axis) and the amount of mist (vertical axis). The amount of mist is shown in $cm^3$ in each hour. It is noted in FIG. 3 that the amount of the generation of the mist increases linearly with the rise of the temperature. The generation of the mist at 70° C. is three times as much as that at 26° C.

As for the efficiency of the generation of the mist, we must consider the power consumption in the heater, therefore, the total power including both for the heater and for the vibrator is somewhat more than that of a conventional ultrasonic wave nebulizer. In any case, the efficiency of the present nebulizer is higher than a conventional heater steam type nebulizer. And further, the present invention provides warm mist which is comfortable to a human body. As for the comfort to a human body, it is preferable that the temperature of the mist is higher than 60° C., and still preferably it is 70° C. at an outlet of a nebulizer. Anyway, the temperature of water is less than the boiling point of water, and is preferably less than 70° C. If the water temperature is too high, it is dangerous to a human body. So, the preferable range of water temperature is between 50° C. and 70° C.

When a heater is a PTC element, the temperature of the mist is determined by selecting the preferable PTC element for the desired temperature.

When the volume of a water container is 130 $cm^3$, a heater is 60 watt for keeping water 60° C., and is 80 watt for 70° C. in winter season.

No control circuit nor timer circuit is necessary for the heater. The vibrator and the heater are energized at the same time upon putting on a power switch. When a nebulizer is put on, water is cool, and the efficiency of the nebulizer is low, so the amount of cool mist until water is heated is small, and it is not uncomfortable. When water is heated in a few minutes, the amount of mist is increased so that humidity in a room is adjusted.

As a modification, a conductive plate 7 may be fixed directly to the container 1, without intervening the frame 6.

As mentioned above, according to the present invention, the efficiency for generation of the mist is considerably higher than that of a prior art, since the water is warmed. And further, as the mist is warm, it is comfortable to a human body, and further, the mist does not decrease room temperature. This is important advantage of the present invention since a room is air-conditioned in winter season when the nebulizer is used.

As a heater is fixed to the rear surface of the conductive plate, a heater and/or a lead line to a heater does not contact with water, and therefore, no dangerous leakage occurs, so, it is safe to a human body, and further no water seal structure of a heater is necessary.

Further, a conductive plate, a vibrator, and a circuit for energizing a vibrator are mounted on a single unit, therefore, the structure is compact and small in size. As the unit is manufactured independently from a water container, and is assembled to a container at the final stage of the manufacturing process, and less manufacturing steps are needed.

Further, as a vibrator is mounted on the same level or height as a conductive plate which contacts with water, the maintenance of a vibrator is easy, since when the vibrator is cleaned, the heater does not disturb the access to the vibrator for cleaning.

From the foregoing it will not be apparent that a new and improved nebulizer has been discovered. It should be understood of course that the embodiments disclosed are merely illustrative and are not intended to limit the scope of the invention. Reference should be made to the appended claims, therefore, rather than the specification as indicating the scope of the invention.

What is claimed is:

1. An ultrasonic wave nebulizer comprising a water container (1), and a piezoelectric vibrator element (9) mounted at bottom of said water container (1) so that said vibrator element (9) contacts with water, and ultrasonic energy generated by said vibrator element (9) converts water to mist; comprising;

said water container (1) having a bottom opening (3) which is closed by a vibrator/heater assembly unit (4) which is water tight, said vibrator/heater assembly unit (4) having a non-conductive frame (6) which has a center hole (6*a*), a ring-shaped conductive plate (7) fixed to said frame (6) so that an outer periphery of the plate (7) engages with an inner periphery of said central hole (6*a*), a resilient cylindrical vibrator holder (8) coupled with an inner periphery of said plate (7), a vibrator element (9) fixed in said vibrator holder (8) so that one surface of the vibrator element (9) contacts with water in said water container (1), at least one flat heater (11) attached at bottom surface of said conductive plate (7), to heat water in the container (1) to temperature lower than boiling point of water, a substrate (12) fixed to said frame (6) so that a spacing is provided between the substrate (12) and the frame (6), a circuit element (13) for energizing said vibrator element (9), mounted on said substrate (12), and means (5) for fixing said (4) to said water container (1).

2. An ultrasonic wave nebulizer according to claim 1, wherein said heater (11) is fan-shaped.

3. An ultrasonic wave nebulizer according to claim 1, wherein a water tight seal (18) is provided between a water container and a vibrator/heater assembly unit.

4. An ultrasonic wave nebulizer according to claim 1, wherein said heater is a PTC ceramics heater.

5. An ultrasonic wave nebulizer according to claim 1, wherein said conductive plate (7) is made of one selected from aluminum, copper and stainless steel.

6. An ultrasonic wave nebulizer according to claim 1, wherein a heat-shield plate (7*a*) is provided under said heater (11).

7. An ultrasonic wave nebulizer according to claim 1, wherein said vibrator element (9) and said heater (11) are energized at the same time upon switching on a power switch.

8. An ultrasonic wave nebulizer according to claim 1, wherein temperature of water in the container (1) is in the range between 50° C. and 70° C.

* * * * *